United States Patent [19]

Rieger

[11] Patent Number: 4,926,574

[45] Date of Patent: May 22, 1990

[54] RIFLE WITH SAFETY SYSTEM

[75] Inventor: Benedikt Rieger, Altenmunster-Hegnenbach, Fed. Rep. of Germany

[73] Assignee: Dynamit Nobel Aktiengesellschaft, Troisdorf, Fed. Rep. of Germany

[21] Appl. No.: 261,224

[22] Filed: Oct. 24, 1988

[30] Foreign Application Priority Data

Oct. 2, 1987 [DE] Fed. Rep. of Germany ..... 3735773

[51] Int. Cl.[5] ..... F41C 17/04

[52] U.S. Cl. ..... 42/70.04; 42/70.05; 42/70.08

[58] Field of Search ..... 42/70.04, 70.05, 70.08

[56] References Cited

U.S. PATENT DOCUMENTS

| | | |
|---|---|---|
| 2,553,995 | 5/1951 | Young . |
| 2,679,706 | 6/1954 | Windle . |
| 2,715,356 | 8/1955 | Fiorini . |
| 3,949,508 | 4/1976 | Elkas . |
| 4,203,348 | 5/1980 | Sokolovsky . |
| 4,494,331 | 1/1985 | Vanderbeck . |

FOREIGN PATENT DOCUMENTS

| | | |
|---|---|---|
| 368807 | 11/1982 | Austria . |

*Primary Examiner*—Charles T. Jordan
*Assistant Examiner*—Richard W. Wendtland
*Attorney, Agent, or Firm*—Antonelli, Terry, Stout & Kraus

[57] ABSTRACT

A rifle exhibits a cage axially movable in the barrel direction, a triggering system, except for the firing lever, being attached to this cage. Preferably, the cage is located within a base box through which extended cage axles are guided in slotted holes. By means of a safety including a cocking and, respectively, uncocking position, two conditions can be set from the rifle stock. In the safety position, the operative connection of the firing lever to a trigger sear lever is interrupted. Additionally, a pin at the trigger sear lever is caught in a slotted hole in the wall of the base box. When a shot is fired, the striker member overcomes a detent at the end of the catch lever because the catch lever can yield in the downward direction. During loading or repeating, the striker member is retracted, and the catch lever is again supported by the trigger sear lever (independently of whether a cocked or uncocked condition prevails). The safety slide can be mounted to the stock of the rifle in any position desired by the rifleman. On account of the optimum position at the neck of the stock, the slide can be operated almost instinctively. However, it is also possible to provide a resilient safety handle at the bottom of the rifle stock; the rifle is cocked only once this safety handle has been pressed against the stock by the trigger hand. When the rifleman lets go of the firearm, the base box moves on its own into the rest position, and the rifle is automatically uncocked.

17 Claims, 5 Drawing Sheets

RIFLE WITH SAFETY SYSTEM

The invention is directed to a rifle comprising a firing pin with striker member and cocking spring, a triggering system with a firing lever or trigger, as well as a safety means for cocking or uncocking the firing pin:

In order to place a (cocked) rifle into the safety mode, the firing pin is usually blocked in a shape-mating fashion by means of a pin or a edge. Applying and/or removing the safety is usually accompanied by a clicking noise.

Another way of applying the safety, i.e. making the triggering of a shot impossible, takes place by relaxing the spring which accelerates the firing pin. In this type of safety, the spring abutment of the cocking spring is displaced. For this purpose, a lever must be operated in the zone of the firing pin.

Although this safety system has been known for a long time, it is not utilized under practical conditions. The movement of the hand from the trigger to the uncocking lever is too cumbersome for the rifleman. Since ordinarily a telescopic sight is likewise mounted to the rifle, access to the uncocking lever is additionally impeded.

The invention has as its objective the development of a safety or uncocking system in connection with a rifle, which system can be operated without cumbersome manipulations.

This objective has been attained by a rifle characterized by a guided cage movable in the direction of the barrel, a catch lever rotationally movably mounted to the cage engaging the striker member in such a way that the firing pin can also be moved with the cage against the cocking spring, this catch lever releasing the striker member only in the cocked condition by operation of the firing lever, and the lever moving the cage being operable from the neck of the stock.

In the rifle of the invention, the safety slide for uncocking the firing pin spring can be mounted at a location where it can be reached most conveniently by the rifleman. Uncocking and recocking thus becomes a "natural" process taking place quasi automatically. Merely a finger movement, rather than an arm movement, is herein required. The position of the hand at the rifle remains practically unchanged. It is also advantageous that no clicking noise occurs any more during cocking of the rifle. Furthermore, it is particularly advantageous that, in a simple way, several additional uncomplicated features can be combined with this construction of the uncocking system, which will be described further hereinafter and which further enhance the reliability and safety of the firearm.

A number of possibilities offer themselves for the operation of the cage movements. The safety slide can be arranged on the side (on the right-hand or left-hand side, depending on the rifleman's wishes) closely above the firing lever at the rifle stock. The cage can also be mounted on top to the shank of the stock. This may require a small manual movement for shifting the lever, but since there is much free space around the lever, this movement needs hardly any special attention, taking place quasi automatically.

The cocking of the system, however, can also be designed so that the cage on account of a spring is always in the uncocked condition, and the system is cocked only by the rifleman by a safety element to be operated at the shank upon firing, at the time the rifleman has already seized the rifle and the finger lies on the firing lever. By keeping the rifle cocked with the firing hand, the movement of the finger at the trigger is not impeded, although this kind of firing will need a certain familiarizing. Such a rifle, however, is automatically uncocked as soon as the hand is removed from the firing lever.

The safety system of this invention can be combined in an especially simple way with further safety mechanisms. The firing lever is fixedly mounted to the rifle and/or to a base box. The remaining triggering system, except for the firing lever, is attached to a movable cage. Force transmission is designed herein in such a way that it is possible only in the cocked condition. Once the cage has been shifted into the uncocked condition, the line of effect from the firing lever to the detent underneath the firing pin is interrupted, and thus triggering of a shot can never happen.

It is also possible to provide still another safety mechanism in conjunction with the uncocking system at the lock, by catching at least one lever of the triggering system at the base box by the displacement of the cage. This again means that, in the uncocked position, triggering of a shot would be impossible solely on account of this feature, because movement of the triggering system is blocked.

Another, especially preferred embodiment of the uncocking system resides in designing the "cocked position" of the system as a labile equilibrium. Two rotationally movable legs, joined together and being under a compressive force, form an "elongated bearing." During bending, the two fulcrums approach each other, and this movement is here utilized for uncocking the striker member.

The converse case, namely the sudden stretching of the bent legs, and thus an inadvertent cocking of the rifle, cannot occur since the cocking always takes place against the bias of the cocking spring.

Transition from the stretched bearing position is automatically obtained in this rifle, for example, when the rifle hits the ground butt first. Due to the deceleration upon impact, forces act on the firing lever and on the cocking system. In this case, the cocking system must deploy the uncocking action faster than the firing lever is triggered; this is attained by the greater mass moment of inertia of the cocking system.

Besides such impacts from the direction of the rifle stock, impacts can also occur from the topside of the rifle (for example when ascending to a high lookout point with the rifle slung over one's shoulder and the rifle hitting branches of a tree, etc.). In a structure with an angled guide lever, an impact on the cocking system creates a torque which also overcomes the elongated bearing and the cage is shifted to such an extent that the firing pin spring is relaxed and firing of a shot is made impossible.

On account of the fact that, in the safety construction of this invention the position of the safety lever is not restricted by other characteristics existing due to the system, further optimization is made possible. This concerns, in particular, the cocking force and/or the cocking distance and the cocking characteristic. The leg length of the guide lever provides the step-down scaling factor. In this arrangement, a leg length ratio in the range of 1:3 is especially preferred, i.e. a cocking distance on the order of 15 mm. By a right-angle arrangement of the legs at the guide lever, the objective is attained that the cocking moment increases during the rotary movement. This is desirable because the spring tension, in an approximation, becomes larger in the same way, and thereby the cocking operation over the cocking distance is completely uniform for the rifleman.

Owing to the advantageous mounting of the safety slide in the region of the rifle stock, the rifleman experiences a "natural" uncocking and, respectively, cocking motion; the cocked condition can always be attained in time; on the other hand, however, the rifleman will uncock the rifle practically "automatically" when he sets the rifle down because shifting of the safety lever is possible without effort. The multiple safety afforded by the system requires only minor additional expenditure.

The invention is illustrated in the accompanying drawings and is described hereinafter by way of example.

Figure 1:
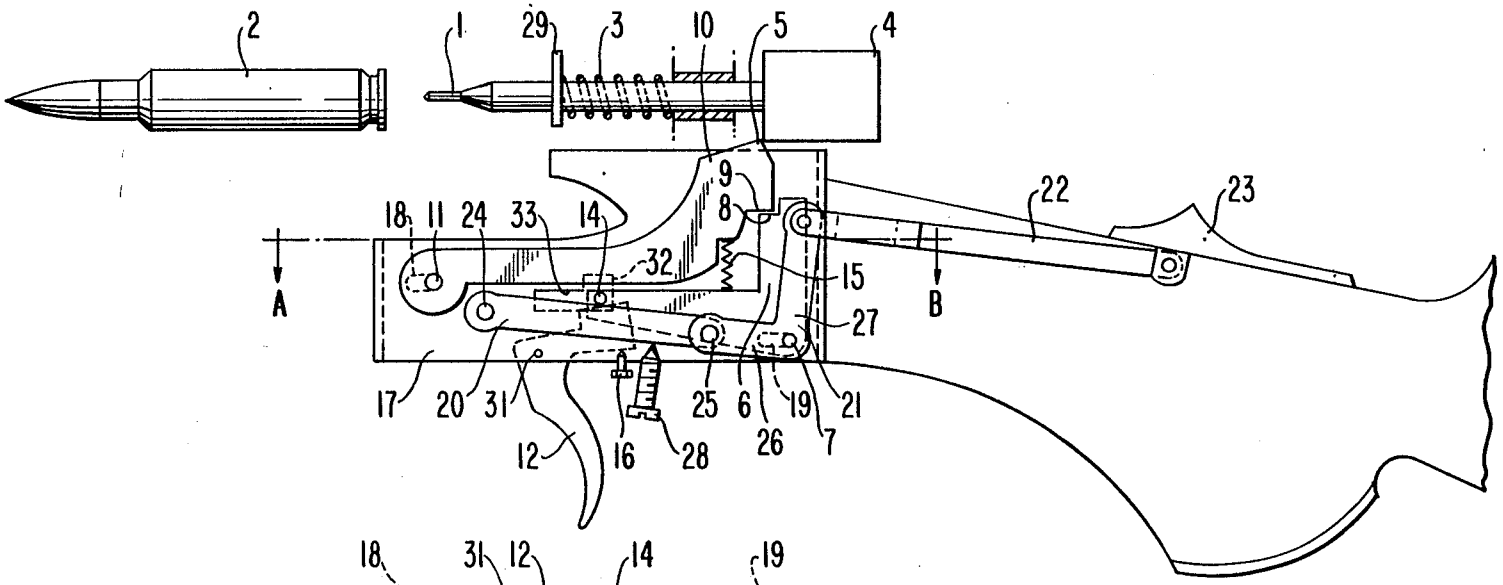
FIG. 1 is a lateral partial schematic view of a rifle with a safety system in a cocked condition ready for firing.

In the illustrations, those parts of the rifle having no relationship with the invention have been omitted; in particular, the repeating system of the rifle is not illustrated.

The firing pin 1 impinges on the primer cap of the cartridge 2 once the striker member 4, cocked by the spring 3, can overcome the detent 5. The blocking and arresting action of the detent 5 is eliminated when the trigger sear lever 6, rotatable about the axle or pin 7, is inclined to such a degree that the shoulder 8 is no longer located below the edge 9 at the catch lever 10. The detent 5 is constituted by the movable end of the catch lever 10, which latter is rotatable about the axle 11.

The catch lever 10 constitutes the triggering system together with the trigger sear lever 6 and the firing lever or trigger 12. Except for the firing lever 12, the triggering system is attached to the cage 13 which is movable in the barrel direction, i.e. in a direction substantially parallel to the movement of the firing pin. Transmission of the triggering movement from the firing lever 12 to the trigger sear lever 6 takes place via a pin 14 at the trigger sear lever 6. In the cocked position (FIG. 1), a torque is transmitted during this step to the trigger sear lever 6. The shoulder 8 slides out from underneath the edge 9 of the catch lever 10. The spring 15 does not have such a strong bias that it could resist the depression of the detent 5 by the cocked striker member 4, and the firing pin 1 impinges upon the primer cap of the cartridge 2. The triggering path can be adjusted by the setscrew 16. The cage 13 is movable in the barrel direction within the base box 17. The cage 13 is guided by lotted holes 18, 19 at the base box 17.

In order to convert the rifle lock from the cocked condition (FIGS. 1, 2) into the uncocked condition (FIGS. 3,4) (and vice versa), an uncocking and, respectively, cracking system is provided with which the cage I3 can be shifted in the barrel direction. In this embodiment, the system consists of a supporting lever 20, a guide lever 21, and a connecting member 22 to the safety slide 23. The supporting lever 20 is mounted at 24 rotatably to the base box 17 and connected at 25 with the short leg 26 of the guide lever 21. The long leg 27 of the guide lever 21 is rotationally movably connected to the connecting member 22. The guide lever 21 is attached to the cage 13. In this case, the axle 7, about which also rotates the trigger sear lever 6, is concomitantly used for this purpose.

Figure 2:
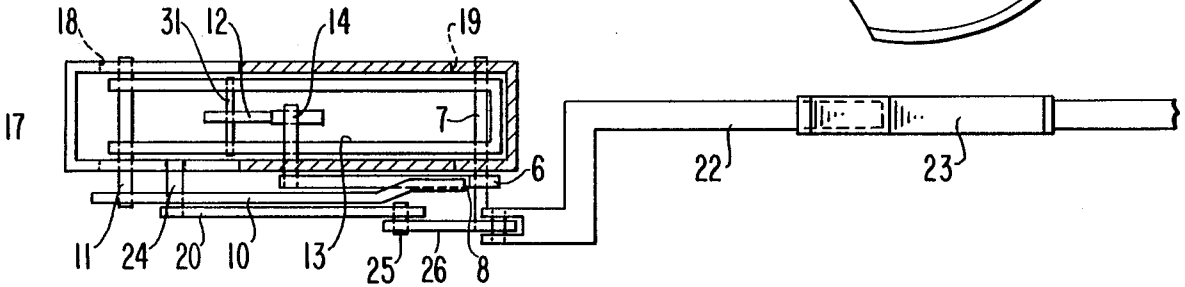
FIG. 2 is a top view of the safety system in the cocked condition ready for firing (section AB according to FIG. 1)

A characteristic feature in this rifle is the "elongated bearing," a labile equilibrium condition of the supporting lever 20 with the short leg 26 of the guide lever 21 in the cocked condition (FIGS. 1, 2). The lever movement is restricted toward one side by the abutment screw 28. The transition into the uncocked condition (FIGS. 3, 4) takes place by itself on account of the cocking spring 3 as soon as the elongated bearing is broken. The extent to which the supporting lever 20 and the guide lever 21 can buckle is determined by the size of the slotted hole 19. The slotted holes in this embodiment exhibit a size of 5 mm; they are, of course, adapted to the cocking spring 3 at the striker pin 1.

In the top view of FIG. 2, the fulcrums and the positions of the axles can be seen even more clearly. The axles 7, 11 attached to the cage 13 are so long that they can take over axial guidance of the cage 13 when they are inserted in slotted holes 18, 19 at the base box 17.

Figure 3:
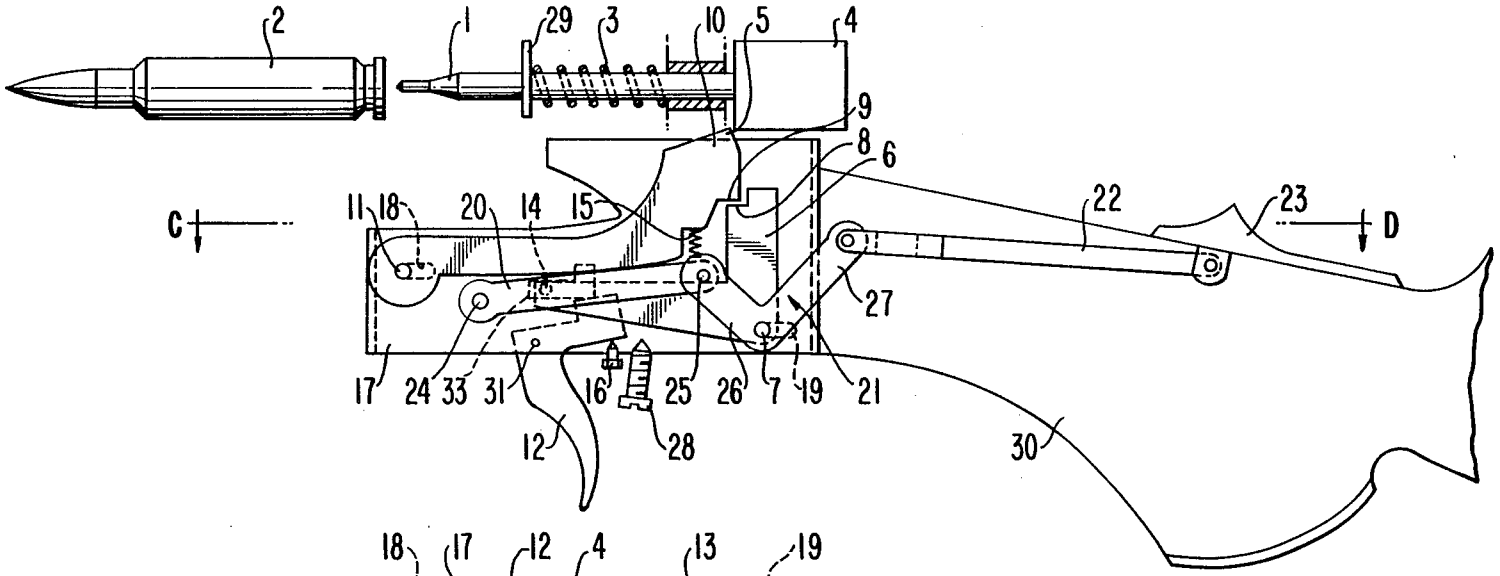
FIG. 3 shows a lateral view of the safety system in the uncocked condition.
Figure 4:
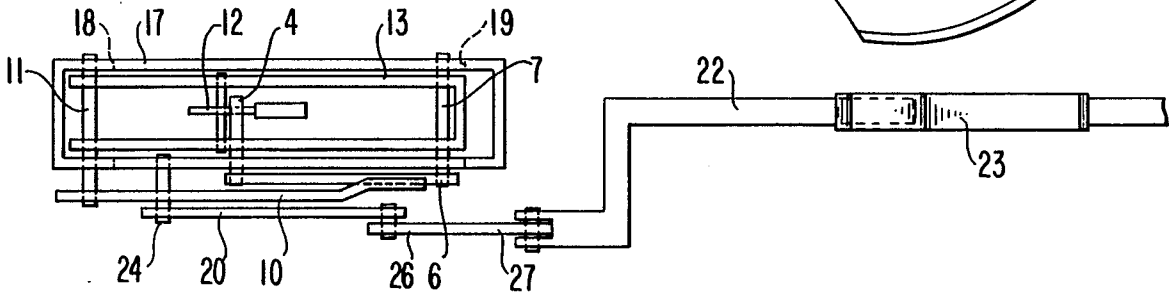
FIG. 4 shows a top view of the safety system in the uncocked condition (section CD of FIG. 3)

FIGS. 3 and 4 show, in correspondence with FIGS. 1 and 2, the safety in the uncocked condition. The spring 3 is relaxed by a corresponding shifting of the spring abutment 29. Also in this position, the striker member 4 is caught by the detent 5. It is impossible in this position for the firing pin 1 to touch the primer cap of cartridge 2.

In the uncocked position, due to the displacement of the safety slide 23 at the stock neck 30, the base box 17 and the cage 13 have such a distance from each other that the firing lever 12 can no longer contact the pin 14 at the trigger sear lever 6. This cocking and, respectively, uncocking by means of the slide 23 takes place without noise.

All elements concerning the repeating action are not illustrated in the drawings, for the sake of clarity. The cocking and/or uncocking system is, however, especially suitable precisely for repeating rifles.

Figure 5:
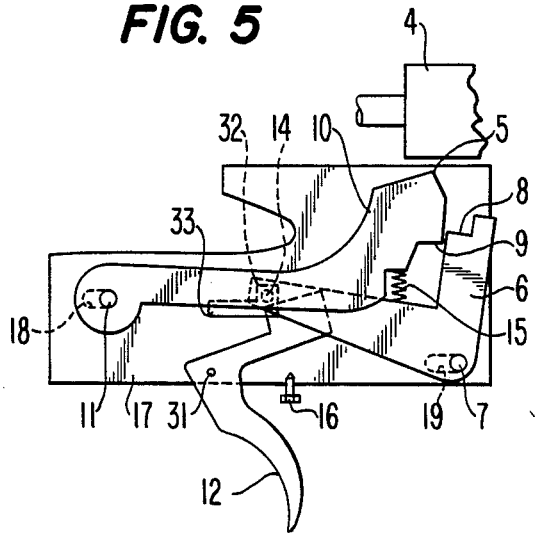
FIG. 5 is a lateral view of the safety system in the triggered condition.

FIG. 5 shows the position of the trigger sear lever 6 and of the catch lever 10 immediately after firing. The edge 9 of the catch lever 10 is no longer resting on the shoulder 8 of the trigger sear lever 6. Thereby, the striker member 4 is able to depress the spring 15. During the loading or repeating procedure, the spring 15 urges the catch lever 10 upwardly, and the striker member 4 is again caught by the detent 5.

In a departure from FIGS. 1 and 3, the cocking and, respectively, uncocking system has additionally also been omitted from FIG. 5 so that the cooperation of the trigger sear lever 6 with the catch lever 10 and the firing lever 12 can be seen even more clearly. The axle 31 of the firing lever 12 is attached to the base box 17. In the wall of the base box 17, an opening 32 can be seen with a slot 33 corresponding to the slotted holes 18, 19, the pin 14 at the trigger sear lever 6 extending into this opening. Thereby, without additional expenditure, a further safety element can be realized because the pin 14 is caught in the slot 33 in the uncocked position. Release of the firing pin 1 is thus impossible in any case.

Figure 6:
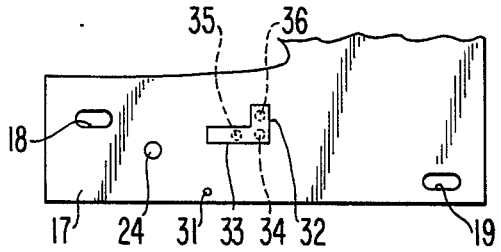
FIG. 6 shows a sidewall of the base box.

The configuration o the sidewall of the base box 17 can be seen still more clearly from FIG. 6. The opening 32, for triggering, must permit movement of the pivot pin 14 in the upward direction; if the pivot pin is caught in the slotted hole zone 33, such movement is not possible.

FIG. 6 shows the three possible positions of the pivot pin 14 in the opening 32 in dashed lines. In the condition ready for firing (as in FIG. 1), the pivot pin 14 is in position 34. With the lock being uncocked (FIG. 3), the pin assumes the position. 35. A movement of the trigger sear lever 6 is impossible. Directly after firing a shot (as in FIG. 5), the pivot pin 14 is in position 36; in this case, only a cartridge case can be located in the barrel.

The shape of the guide lever 21 is preferably asymmetrical and right-angled. The length of the legs 26, 27 provides the step-down or step-up ratio; a ratio of 1:3 is especially preferred. With a cocking distance of, for example, 5 mm, the slide 23 must be moved by 15 mm. In this case, the slotted holes 18, 19, 33, must also make a clearance of 5 mm possible (with a pin diameter of 5 mm).

The unequal lever length at the guide lever 21 also means a mass asymmetry acting toward the "safety" side. Uncocking of the lock takes place, due to relatively large masses of the uncocking system as compared with the firing lever, more rapidly than a movement of the triggering system. Since triggering is no longer possible, from a specific extent of uncocking, unintended firings, especially accidental ones, are no longer possible. If an impact is exerted on this firearm from above against the cocking system, which can happen, for example, when climbing a ladder, the two levers pass over from the stretched position into the bent position, and the lock is uncocked. If the firearm drops to the ground stock first, then uncocking likewise takes place immediately.

The safety slide can be attached to the neck of the stock in any position desired by the rifleman. With an optimum positioning at the rifle stock, the slide can be operated almost instinctively.

Figure 7:
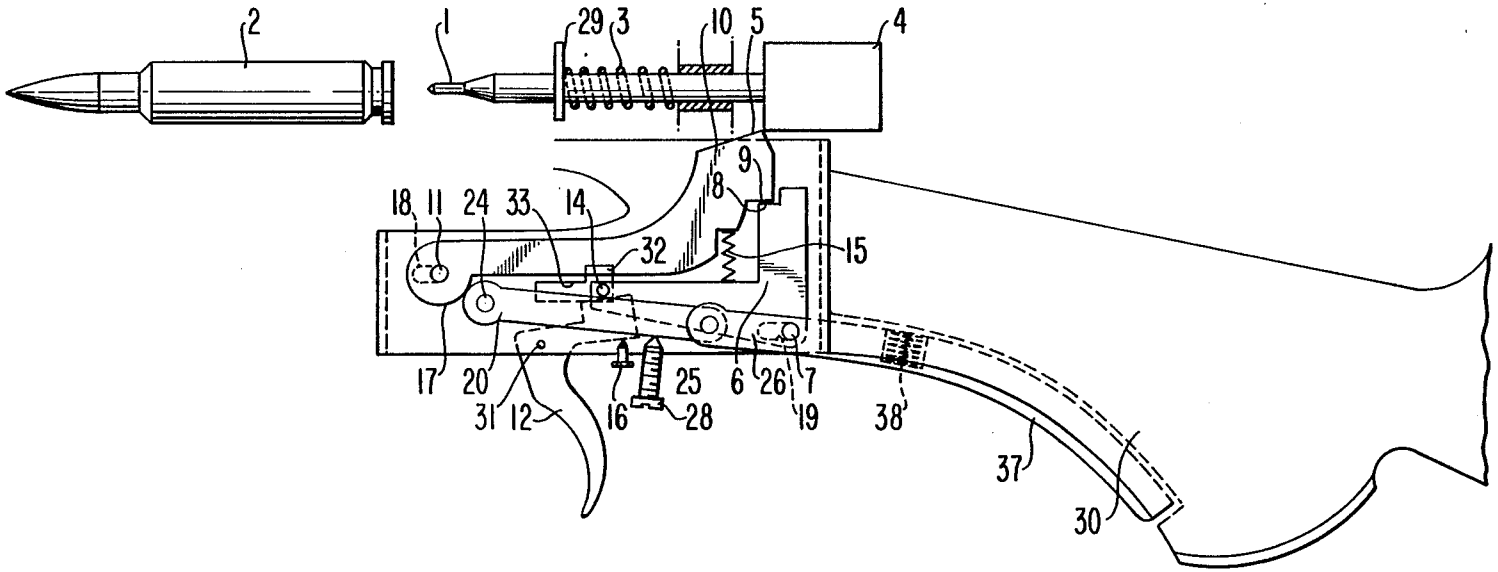
FIG. 7 shows a lateral view of the safety system in a condition ready for firing, as in FIG. 1, with another type of cocking mechanism.
Figure 8:
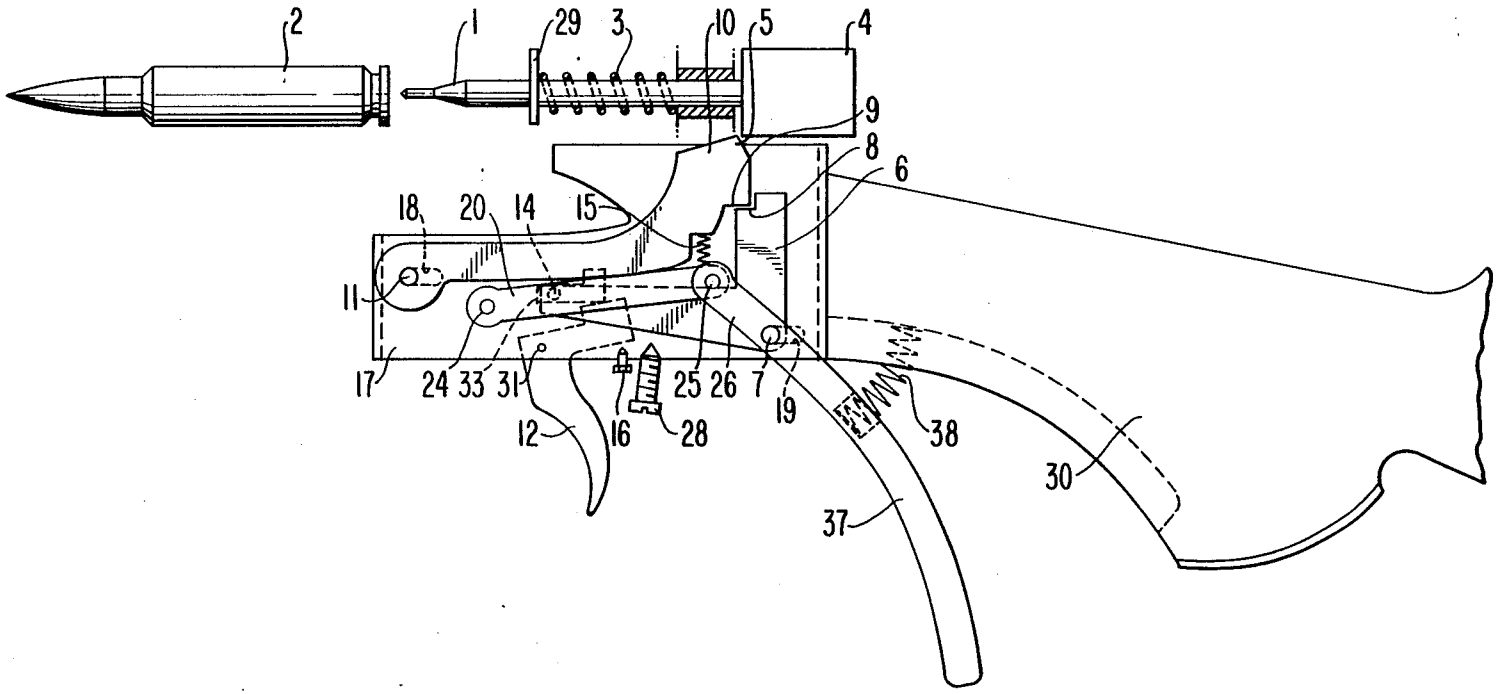
FIG. 8 is a lateral view of the safety system in the uncocked condition, as in FIG. 3, with the different type of cocking mechanism.

FIGS. 7 and 8 show another version of the cocking mechanism. Instead of cocking the rifle by way of a safety slide 23 mounted to the neck of the rifle stock 30, cocking is performed in FIG. 7 by pressing an operating handle 37 against the stock neck 30. The guide lever, angled in FIGS. 1–4, is substantially straight in this embodiment. This lever, in the same manner as in the former figures, is attached to the axle 7 about which the trigger sear lever 6 can be turned, and thus is also movable in the direction of the slotted hole 19.

When the rifle is released, the operating lever 37 is automatically urged away from the rifle neck 30 due to the compression spring 38, whereby the uncocked condition (see FIG. 8) is attained as in FIG. 3. The structure of the safety lever 37 is not fully illustrated in the drawing. In the illustrations, the analogy to the embodiment in FIGS. 1 and 3 is emphasized, above all.

What is claimed is:

1. A rifle, comprising a firing pin with a striker member and a cocking spring, a triggering system with a trigger, and safety means having a cocked position and an uncocked position operatively associated with the stock of the rifle, a guided cage movable in a direction of a barrel of the rifle, a catch lever rotationally movably attached to the cage engaging the striker member so that the firing pin can also be moved against a cocking spring with the cage, said catch lever releasing the striker member only in the cocked condition by operation of the trigger and a lever of the safety means that moves the cage being operable from a stock neck of the rifle.

2. A rifle according to claim 1, wherein a base box compassing the cage is provided, the trigger being attached to said box.

3. A rifle according to claim 1 further comprising a guide means for shifting the cage so that, in the cocked position, the striker member is maximally tensioned, and, in the uncocked position, any contact of a primer cap of a cartridge by a tip of the firing pin is precluded.

4. A rifle according to claim 2 further comprising a guide means for shifting the cage so that, in the cocked position, the striker member in maximally tensioned, and, in the uncooked position, any contact of a primer cap of the cartridge by a tip of the firing pin is precluded.

5. A rifle according to claim 1, wherein the movement of the cage is in the range of 5 mm.

6. A rifle according to claim 1, wherein the cage is guided by means of shafts passing through slotted holes at a base box secured to the stock of the rifle and supported at the cage.

7. A rifle according to claim 1, wherein the triggering system, except for the trigger is attached to the cage, and, in the uncocked position, an operative connection from the trigger to the catch lever and, respectively the striker member is interrupted.

8. A rifle according to claim 6, wherein a trigger sear lever is provided between the trigger and the catch lever, an edge of the catch lever resting on a shoulder of the trigger and yielding of a detent on the catch lever becomes possible only once the trigger sear lever in the cocked position, is rotated outwardly by the trigger.

9. A rifle according to claim 2, wherein the uncocked condition, at least a part of the trigerring system, especially the trigger sear lever, is caught in a recess in the base box.

10. A rifle according to claim 1, wherein the safety means comprise a supporting lever and a guide lever, one side of the supporting lever being attached to a base box, the other side of the supporting lever being connected to a leg of the guide lever, the guide lever being rotatable about an axle attached to the cage, and another leg of the guide lever being connected to a safety slide or a safety lever.

11. A rifle according to claim 9, wherein the safety slide is mounted on one side or on the top of the rifle stock.

12. A rifle according to claim 10, wherein the supporting lever is attached to the same axle as the trigger sear lever.

13. A rifle according to claim 12, wherein in the cocked condition, the supporting lever and a leg of the guide lever form an elongated bearing.

14. A rifle according to claim 13, wherein a screw is provided for fixing an abutment for the supporting lever in the cocked condition.

15. A rifle according to claim 14, wherein the ratio of the length of the legs of the guide lever is in the range of 1:3.

16. A rifle according to claim 10, wherein a resilient safety handle is mounted at the stock so that the safety handle can be pressed by the trigger hand, and the safety means is cocked during this step, but, on account of a spring, the rifle will revert to its uncocked condition as soon as the safety handle is no longer pressed.

17. A rifle according to claim 16, characterized in that the safety handle is mounted to the same axle as the trigger sear lever.

* * * * *